US005443294A

United States Patent [19]

Prinz et al.

[11] Patent Number: 5,443,294

[45] Date of Patent: Aug. 22, 1995

[54] SINGLE-LINE CLAMSHELL BUCKET

[75] Inventors: Peter F. Prinz, Ethel; Jeffery L. Wallace, Baker; Jon A. Craft, Slaughter, all of La.

[73] Assignee: HAWCO Manufacturing Co., Slaughter, La.

[21] Appl. No.: 125,334

[22] Filed: Sep. 22, 1993

[51] Int. Cl.[6] ..... B66C 3/02

[52] U.S. Cl. ..... 294/68.23; 37/186; 294/905

[58] Field of Search ..... 294/68.23, 88, 110.1, 294/111, 112, 119.4, 905; 37/461, 184–188; 414/624, 625, 739

[56] References Cited

U.S. PATENT DOCUMENTS

| | | | |
|---|---|---|---|
| 1,301,626 | 4/1919 | Watters | 37/186 |
| 1,477,530 | 12/1923 | Barnard | 37/186 |
| 1,717,549 | 6/1929 | Brosius | 37/184 |
| 1,817,595 | 8/1931 | Wallace | 37/186 |
| 3,314,709 | 4/1967 | Guinot | 294/68.23 |
| 3,561,812 | 2/1971 | Dixon | 294/110.1 |
| 3,589,766 | 6/1971 | Bormioli | 294/88 X |
| 3,606,435 | 9/1971 | Weber | 294/68.23 |

(List continued on next page.)

FOREIGN PATENT DOCUMENTS

| | | | |
|---|---|---|---|
| 232230 | 3/1964 | Austria | 294/68.23 |
| 870312 | 3/1942 | France | 294/68.23 |
| 3421617 | 1/1985 | Germany | 294/68.23 |
| 273191 | 4/1951 | Switzerland | 294/68.23 |

OTHER PUBLICATIONS

EG Peiner Single Line Grabs brochure, no date.
Light Weight/Medium Weight Radio Control Buckets, Mack Manufacturing, Inc. brochure, no date.
Single Line Remote Control Clamshell Bucket, McGinnes Manufacturing Co. brochure, no date.

*Primary Examiner*—Johnny D. Cherry
*Attorney, Agent, or Firm*—William David Kiesel; Robert C. Tucker

[57] ABSTRACT

A single-line clamshell bucket is provided comprising an upper sheave housing and an upper sheave assembly connected to the upper sheave housing. The bucket also comprises a lower sheave assembly vertically aligned beneath the upper sheave assembly in a manner such that a cable reeved between the lower sheave assembly and the upper sheave assembly will draw the upper sheave assembly and the lower sheave assembly together when the cable is pulled upward. The bucket further has a plurality of bucket segments and a plurality of arms, each of the arms having an end pivotally connected to the upper sheave housing and another end pivotally connected to one of the bucket segments. A lower block assembly is pivotally linked with the bucket segments in a manner such that vertical movement of the lower block assembly in relation to the upper sheave housing opens and closes the bucket segments. The bucket includes a connector device for mechanically connecting the lower sheave assembly and the lower block assembly when the bucket segments are supporting the weight of the clamshell bucket. Finally, the bucket includes a damping assembly comprising a first lever arm, having a first and second end, rigidly attached at the first end to the lower block assembly. The damping assembly also includes a second lever arm, having a first and second end, rigidly attached at the first end to a bucket segment in a manner such that a force acting on the second end of the second lever arm will cause the bucket segments to pivot. The damping assembly further has a damping element including: a cylinder and a ram forming a hydraulic cylinder and ram assembly, pivotally mounted at one end to the second end of the first lever arm and pivotally mounted at an opposite end to the second end of the second lever arm; a hydraulic fluid reservoir, in fluid connection with the cylinder, and a hydraulic fluid flow control device, connected between the cylinder and the hydraulic fluid reservoir, for restricting the rate of flow of hydraulic fluid from the cylinder into the hydraulic fluid reservoir when the ram is urged in a predetermined direction within the cylinder.

27 Claims, 11 Drawing Sheets

U.S. PATENT DOCUMENTS

| | | | |
|---|---|---|---|
| 3,750,311 | 8/1973 | Anderson | 294/110.1 X |
| 3,768,853 | 10/1973 | Rennie | 294/110.1 |
| 3,774,954 | 11/1973 | Taguchi et al. | 294/68.23 |
| 3,790,204 | 2/1974 | Lighthipe et al. | 294/110.1 |
| 3,814,471 | 6/1974 | Coeurderoy | 294/68.23 |
| 3,934,917 | 1/1976 | Paxton et al. | 294/68.23 |
| 4,043,580 | 8/1977 | Thaule | 294/69.23 |
| 4,047,313 | 9/1977 | Bricon | 294/68.23 X |
| 4,059,886 | 11/1977 | Bricon | 294/68.23 X |
| 4,174,131 | 11/1979 | Gregg | 294/68.23 |
| 4,327,943 | 5/1982 | Longo | 294/68.23 |
| 4,381,872 | 5/1983 | Hahn | 294/68.23 |
| 4,538,848 | 9/1985 | Aberkrom | 294/68.23 |
| 4,807,918 | 2/1989 | Weeks | 294/110.1 |
| 4,998,762 | 3/1991 | Bergeron | 294/68.23 |
| 5,199,194 | 4/1993 | Scott | 294/68.23 X |
| 5,228,735 | 7/1993 | Morrow | 294/68.23 |

SINGLE-LINE CLAMSHELL BUCKET

BACKGROUND OF THE INVENTION

1. Field of the Invention

This invention relates generally to material handling devices and, more particularly, to clamshell buckets, operable from a single-line, which can open while suspended in midair from a single line.

2. Prior Art

It is often desirable to use a clamshell bucket with a crane or boom having only one line capability. A problem with currently available one-line clamshell buckets is the inability of most of these devices to open while suspended in midair. This is a problem because it is often desired to transfer the bucket load directly onto a truck or rail car for further transport. It can be impossible to load these vehicles with a conventional one line clamshell bucket because the conventional clamshell bucket requires that the bucket be set down before the bucket segments will open. U.S. Pat. No. 4,174,131 to Gregg, discloses an example of such a clamshell bucket.

U.S. Pat. No. 4,381,872 to Hahn, issued May 3, 1983, discloses a single-line clamshell bucket which may be opened while suspended in midair. The Hahn clamshell bucket has a hydraulic assembly connected between the bucket segments and the lower sheave assembly. The hydraulic assembly is controlled by an operator via a radio link. The hydraulic cylinder is unlocked when it is desired to permit discharge of the clamshell bucket. When the bucket is set down to pickup another load, the weight of the lower sheave assembly forces the hydraulic ram back into the hydraulic cylinder. Once the hydraulic ram has forced the hydraulic fluid from the hydraulic cylinder, the hydraulic assembly may then be locked by the operator in order to pickup another load.

A problem with this type of single-line clamshell buckets is the time required to reset the hydraulic assembly between the unloading and loading cycles.

Additionally, it is also a problem with conventional clamshell buckets having single-line capability that the release of the contents of the bucket causes a dramatic shock to the boom or crane. This can be dangerous as well as cause expensive, time consuming damage and delays.

SUMMARY OF THE INVENTION

Therefore, one object of the present invention is to provide an engaging device, mountable within a single-line clamshell bucket, for disengaging the lower sheave assembly and the lower block assembly of a single-line clamshell bucket while the clamshell bucket is suspended in midair by a single cable.

Another object of the present invention is to provide a damping device, that is mountable in a single-line clamshell bucket having bucket segments pivotally mounted to a lower block assembly in a manner such that the pivotal movement of one of the bucket segments requires the pivotal movement of all other bucket segments, for damping the forces associated with opening a clamshell bucket while suspended in midair.

A further object of the present invention is to provide a single-line clamshell bucket which can be opened while the bucket is suspended in midair by a single cable.

A still further object of the present invention is to provide a single-line clamshell bucket having dampening means for dampening the forces associated with opening the bucket segments while the bucket is suspended in midair.

Accordingly, an engaging device, mountable in a single-line clamshell bucket, for engaging and disengaging the lower sheave assembly and the lower block assembly of a single-line clamshell bucket is described. The device comprises: a hook assembly, a biasing element, a pin assembly and an engagement retaining assembly. The hook assembly includes a hook member pivotally mounted to the clamshell bucket. The biasing element is connected to the hook assembly in a manner such that the hook member is biased in a first rotational direction but is deflectable in a second rotational direction by a force generated by the weight of the lower sheave assembly. The pin assembly has a pin including a first surface adapted for engagement with a second surface of the hook member in a manner such that, when the first and second surfaces are engaged, a force acting to separate the lower sheave assembly and the lower block assembly will act to generate a disengaging force against the hook member in the second rotational direction. The engagement retaining assembly includes: a bracket member; a pivoting member, pivotally mounted to the bracket member in a manner such that a portion of the pivoting member may operatively contact the hook member when the hook member and pin are engaged; and locking assembly, in mechanical connection with the pivoting member, for locking the pivoting member in a desired position. The locking assembly is selectably unlockable by an operator and has sufficient holding strength to resist the disengaging force when locked.

In a preferred embodiment, the engagement retaining assembly further includes: a roller member, having an axle member in connection with the center of rotation of the roller member and an outer surface adapted to rollingly contact the hook member; and axle member guide means for receiving the axle member and for guiding translational movement of the roller member along a predetermined pathway toward and away from the hook member.

In another preferred embodiment, the bracket member includes the roller member guide means and the pivoting member includes a curved surface having both inwardly and outwardly curved portions for contacting the roller member.

In a further preferred embodiment the locking assembly includes: a hydraulic cylinder and ram assembly, pivotally mounted at one end to the pivoting member and pivotally mounted at the other end to the bracket member; a hydraulic fluid reservoir, in fluid connection with the hydraulic cylinder; and a valve, controllable by an operator, connected between the hydraulic cylinder and the hydraulic fluid reservoir.

In a still further preferred the locking assembly further includes a radio transmitter, controllable by an operator; a radio receiver having an output port controllable by the radio transmitter; and the valve is a solenoid controlled valve in electrical connection with the output port of the radio receiver.

Also, a force damping device, for damping the forces associated with opening a clamshell bucket while suspended in midair, that is mountable in a single-line clamshell bucket, having bucket segments pivotally mounted to a lower block assembly in a manner such that the pivotal movement of one of the bucket segments requires the pivotal movement of all other bucket segments, is described. The device comprises: a first lever arm, a second lever arm and a damping assembly. The first lever arm member is rigidly attached at one end to the lower block assembly. The second lever arm member is rigidly attached at one end to a bucket segment in a manner such that a force acting on the other end of the second lever arm will cause the bucket segments to pivot. The damping assembly includes: a hydraulic cylinder and ram assembly, pivotally mounted at one end to that end of the first lever arm member not rigidly attached to the lower block assembly and pivotally mounted at the other end to that end of the second lever arm member not rigidly attached to a bucket segment; a hydraulic fluid reservoir, in fluid connection with the hydraulic cylinder; and a hydraulic fluid flow control device, controllable by an operator and connected between the hydraulic cylinder and the hydraulic fluid reservoir, for restricting the rate of flow of hydraulic fluid from the hydraulic cylinder into the hydraulic fluid reservoir when the hydraulic ram is urged in a predetermined direction within the hydraulic cylinder.

In a preferred embodiment the hydraulic cylinder and ram have sufficient holding strength to stop and hold the bucket segments in a partially open position when the bucket segments are moving between a fully closed and fully open position, and the hydraulic fluid flow control device further includes: a radio transmitter, controllable by an operator; a radio receiver having an output port controllable by the radio transmitter; and a solenoid controlled valve in electrical connection with the output port of the radio receiver.

Additionally, a single-line clamshell bucket which comprises: an upper sheave housing, an upper sheave assembly, a lower sheave assembly, a plurality of bucket segments, a plurality of arms, a lower block assembly, a guide means and a connector assembly, is described. The upper sheave assembly is connected to the upper sheave housing. The lower sheave assembly is vertically aligned beneath the upper sheave assembly in a manner such that a cable reeved between the lower sheave assembly and the upper sheave assembly will draw the upper sheave assembly and the lower sheave assembly together when the cable is pulled upward. Each of the arms has an end pivotally connected to the upper sheave housing and another end pivotally connected to one of the bucket segment members. The lower block assembly is pivotally linked with the bucket segment members in a manner such that vertical movement of the lower block assembly in relation to the upper sheave housing opens and closes the bucket segment members. The guide means is operationally connected between the upper sheave housing and the lower block assembly, and suppresses relative movement of the upper sheave housing and the lower block assembly in directions other than directly toward and away from each other. The connector assembly mechanically connects the lower sheave assembly and the lower block assembly when the bucket segment members are supporting the weight of the clamshell bucket and allows an operator to selectively disconnect the lower sheave assembly from the lower block assembly once the lower sheave assembly and the lower block assembly are mechanically connected.

A preferred clamshell bucket includes the engagement device previously described including any or all the preferred embodiments thereof.

A further preferred embodiment of the clamshell bucket also includes the damping device previously described including any or all the preferred embodiments thereof.

PREFERRED EMBODIMENT OF THE INVENTION

Without limiting the scope of the invention, a preferred embodiment of the invention is described.

The clamshell bucket of the present invention is operable with a single line. This means that cranes and booms having only one line, such as those commonly found on docks and ships, may be used with the clamshell bucket of the present invention to load and unload cargo. A major advantage of the clamshell bucket of the present invention is the ability of the bucket to open while the bucket is suspended in midair. Other major advantages of the clamshell bucket of the present invention are: (i) faster recovery time between opening and closing of the bucket; (ii) reduced impulse shock, caused by opening the bucket in midair, to the boom or crane supporting the bucket; (iii) lower head room; (iv) greater lip force; and (v) safer operation.

Figure 1:
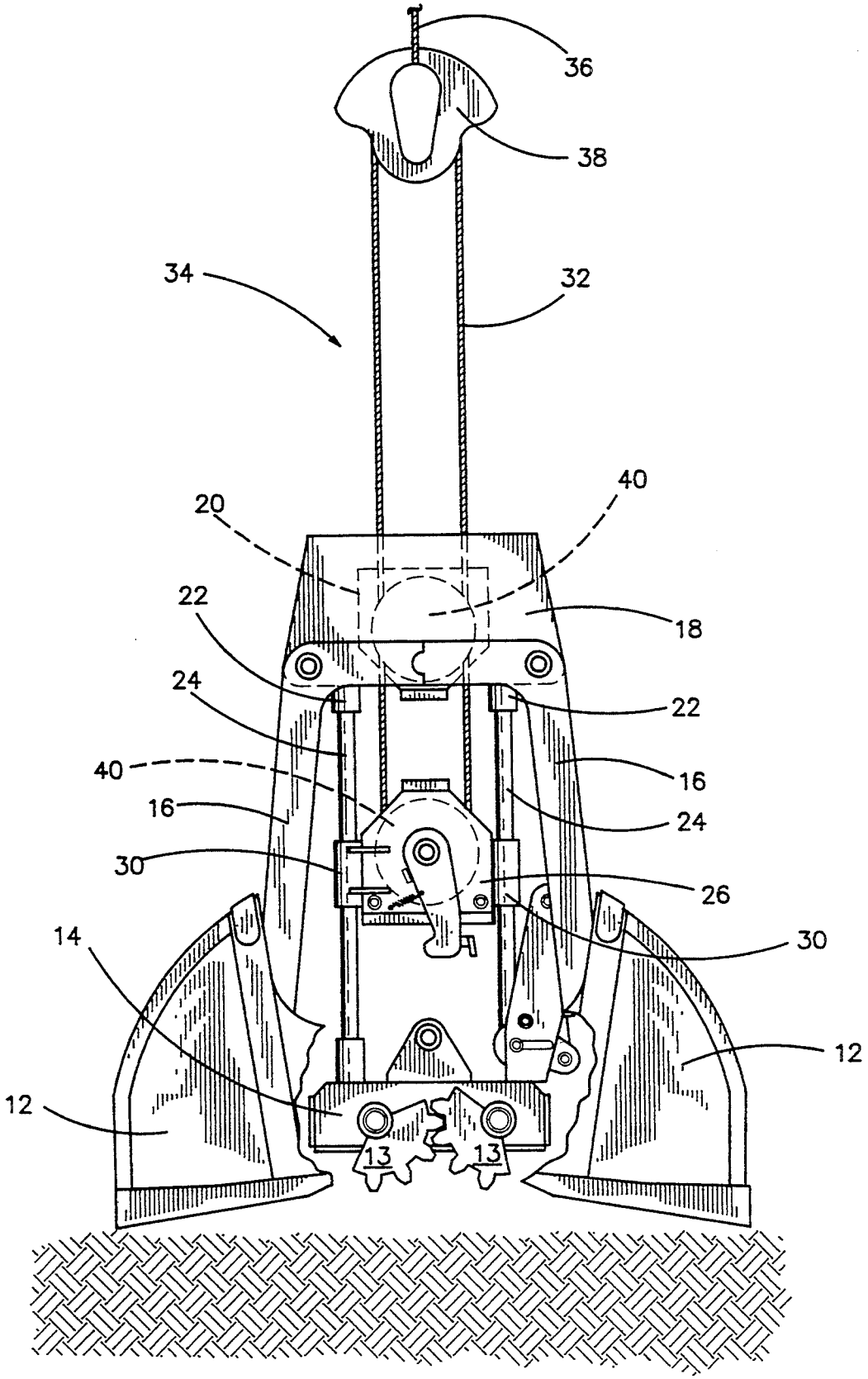
FIG. 1 is a side view schematic of the clamshell bucket with the lower sheave assembly disengaged from the lower block assembly.
Figure 2:
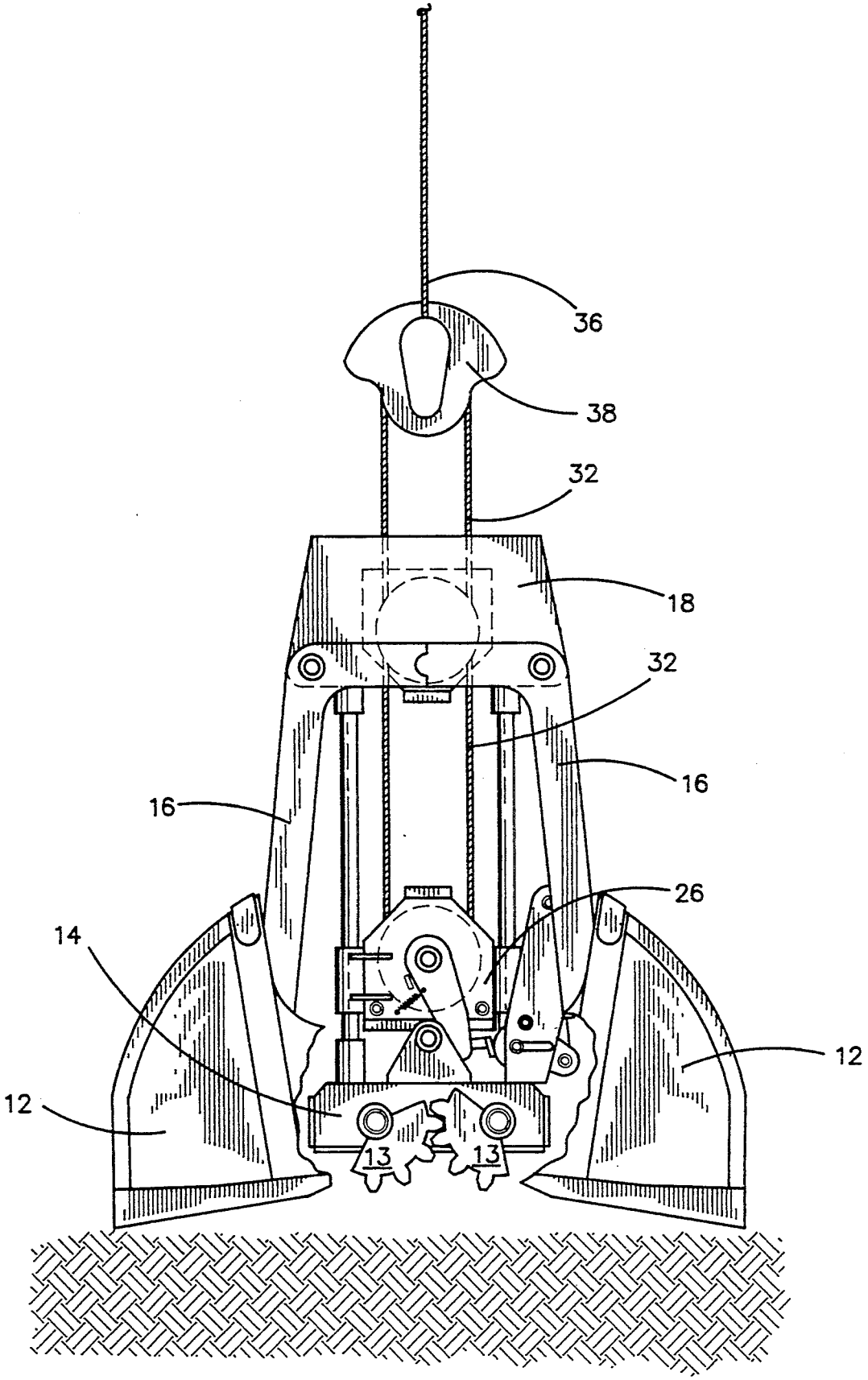
FIG. 2 is a side view schematic of the bucket segments of the clamshell bucket closing as the upper and lower sheave assemblies are drawn together by a cable.

FIG. 1 illustrates the major components of a preferred embodiment of the clamshell bucket of the invention. In this preferred embodiment the bucket includes two concave bucket segments 12. The bucket segments are pivotally mounted between a lower block assembly 14 and one end of each of four support arms 16. Two gears 13 are rigidly attached to each bucket segment 12 at its pivotal connection with the lower block assembly. The gears 13 of each bucket segment 12 mesh with the gears 13 of the other bucket segment 12 in a manner such that the pivotal movement of one of the bucket segments 12 requires the pivotal movement of the other bucket segment 12. This movement is illustrated in FIG. 3.

Referring back to FIG. 1, the other end of each of the support arms 16 is pivotally mounted to the upper sheave housing 18. An upper sheave assembly 20 is rigidly mounted to the upper sheave housing 18. The upper sheave housing 18 also includes guide rod guides 22 for slidably receiving guide rods 24 which are connected to the lower block assembly 14. A lower sheave assembly 26 is slidably mounted on the guide rods 24, between the upper sheave assembly 20 and the lower block assembly 14, by lower sheave guides 30. A single cable 32 is reeved between the pulleys 40 installed in the upper and lower sheave assemblies 20, 26 to form a reeving loop 34. In use, the reeving loop 34 is attached to the single line 36 of a crane or boom at connector 38. As the connector 38 is drawn upward by the crane or boom, the upper and lower sheave assemblies 20, 26 are drawn together.

Figure 3:
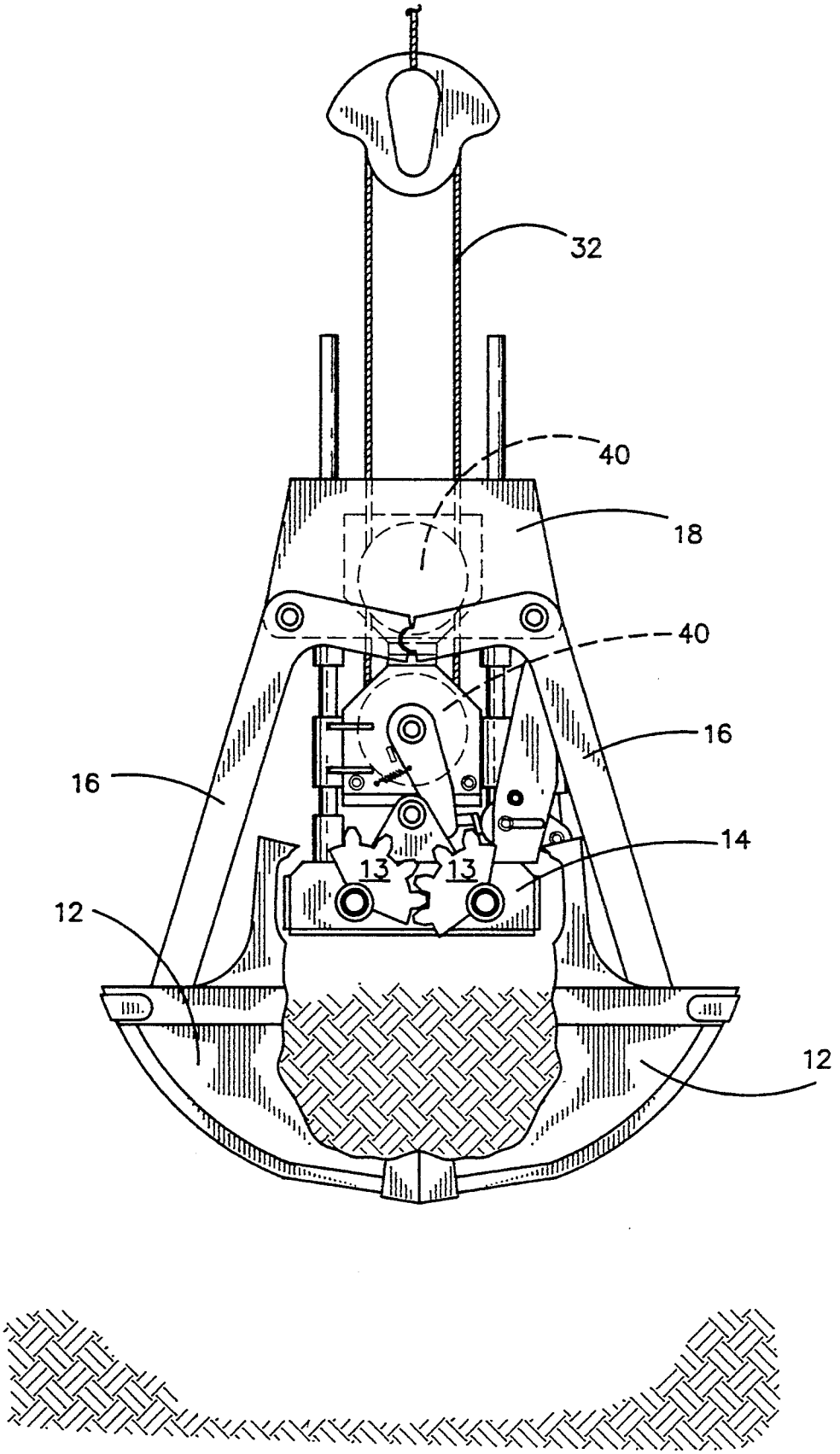
FIG. 3 is a side view schematic of the clamshell bucket just after lower sheave assembly is mechanically connected to the lower block assembly.
Figure 4:
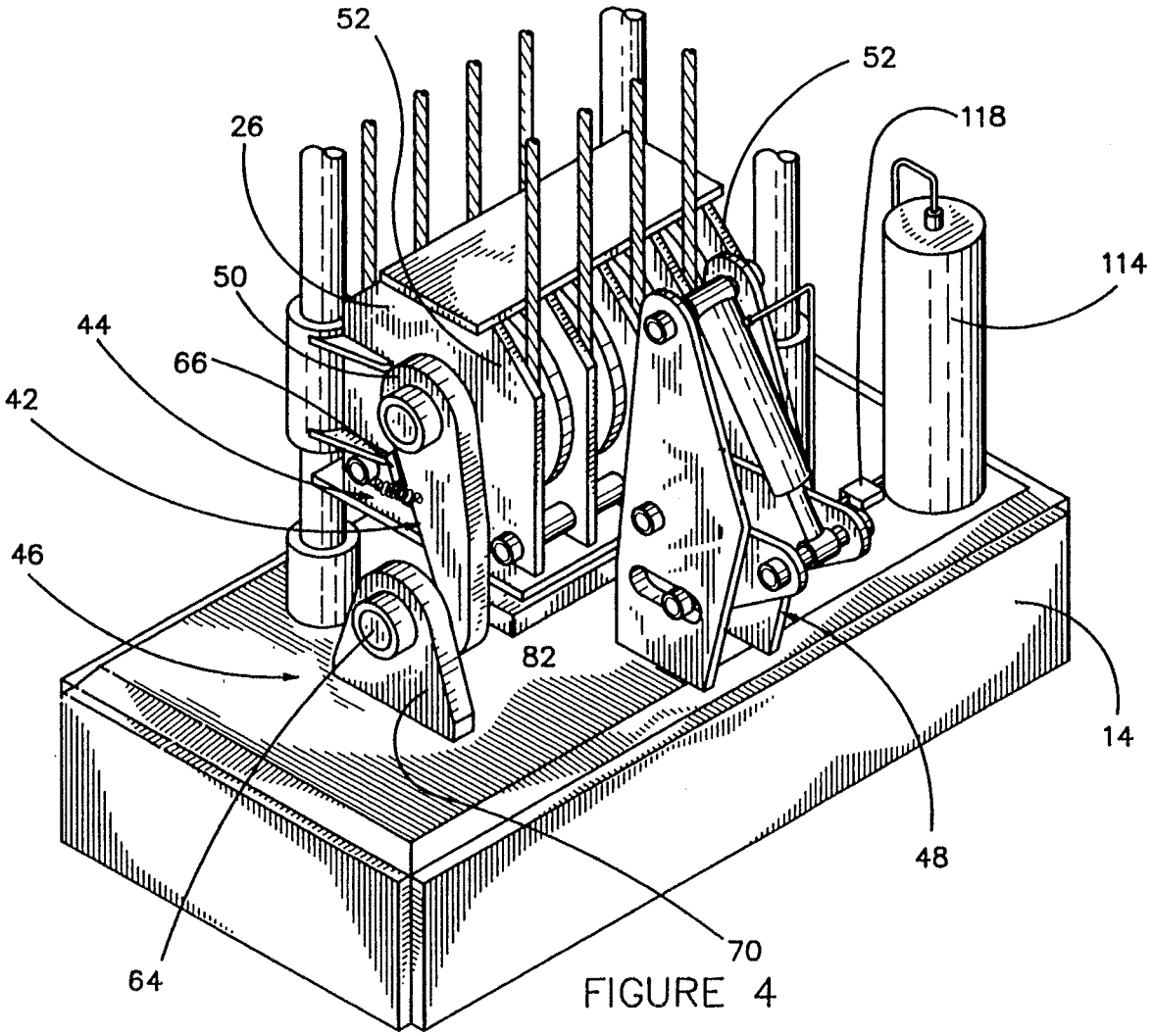
FIG. 4 is an isometric view of a preferred engagement device in connection with the lower sheave assembly and the lower block assembly.
Figure 5:
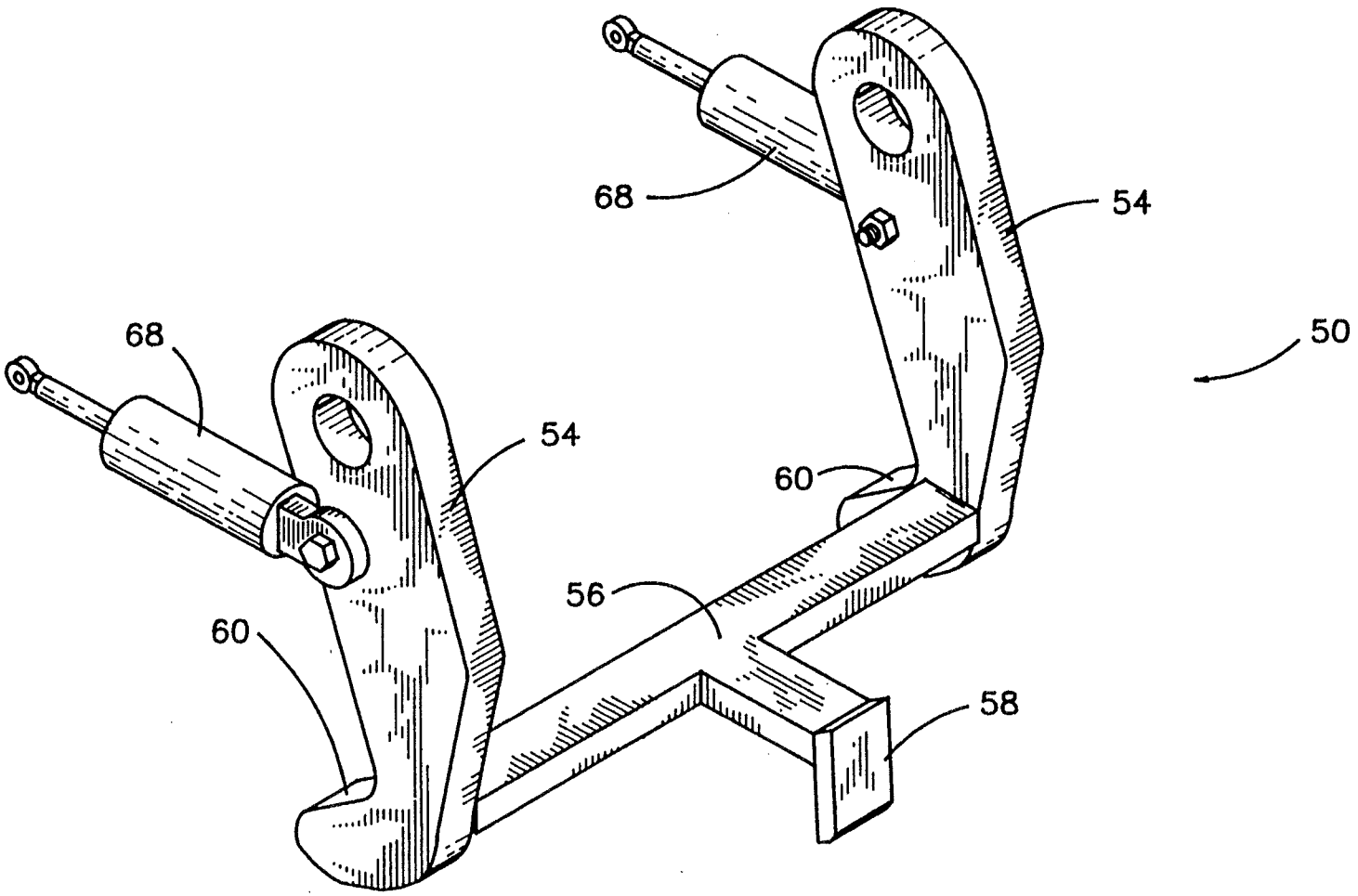
FIG. 5 is a schematic view of a preferred hook member of the engagement device.

As shown in FIG. 3, movement of the lower block assembly 14 in a direction toward the upper sheave housing 18 causes the bucket segments 12 to pivot about the support arms 16 into the closed position. The force which moves the lower block assembly 14 toward the upper sheave housing 18 is provided by the cable 32 reeved through the pulleys 40 within the lower sheave assembly 26 and the upper sheave assembly 20. Gravitational forces, from the weight of the block assembly 14 and any load that may be in the bucket, operate to urge the bucket segments 12 into an open position when the bucket is suspended in midair. In order to close the bucket segments 12, when the clamshell bucket is in the configuration shown in Pig. 2, the clamshell bucket requires an engagement device for engaging and disengaging the lower block assembly 14 and the lower sheave assembly A preferred embodiment of the engagement device of the present invention is shown in FIGS. 4–10. FIG. 4 is an isometric view illustrating a preferred engagement device in connection with the lower sheave assembly 26 and the lower block assembly 14. The engagement device comprises: a hook assembly, generally indicated by the numeral 42; a biasing element, generally indicated by the numeral 44; a pin assembly, generally indicated by the numeral 15 and an engagement retaining assembly, generally indicated by the numeral 48.

Figure 6:
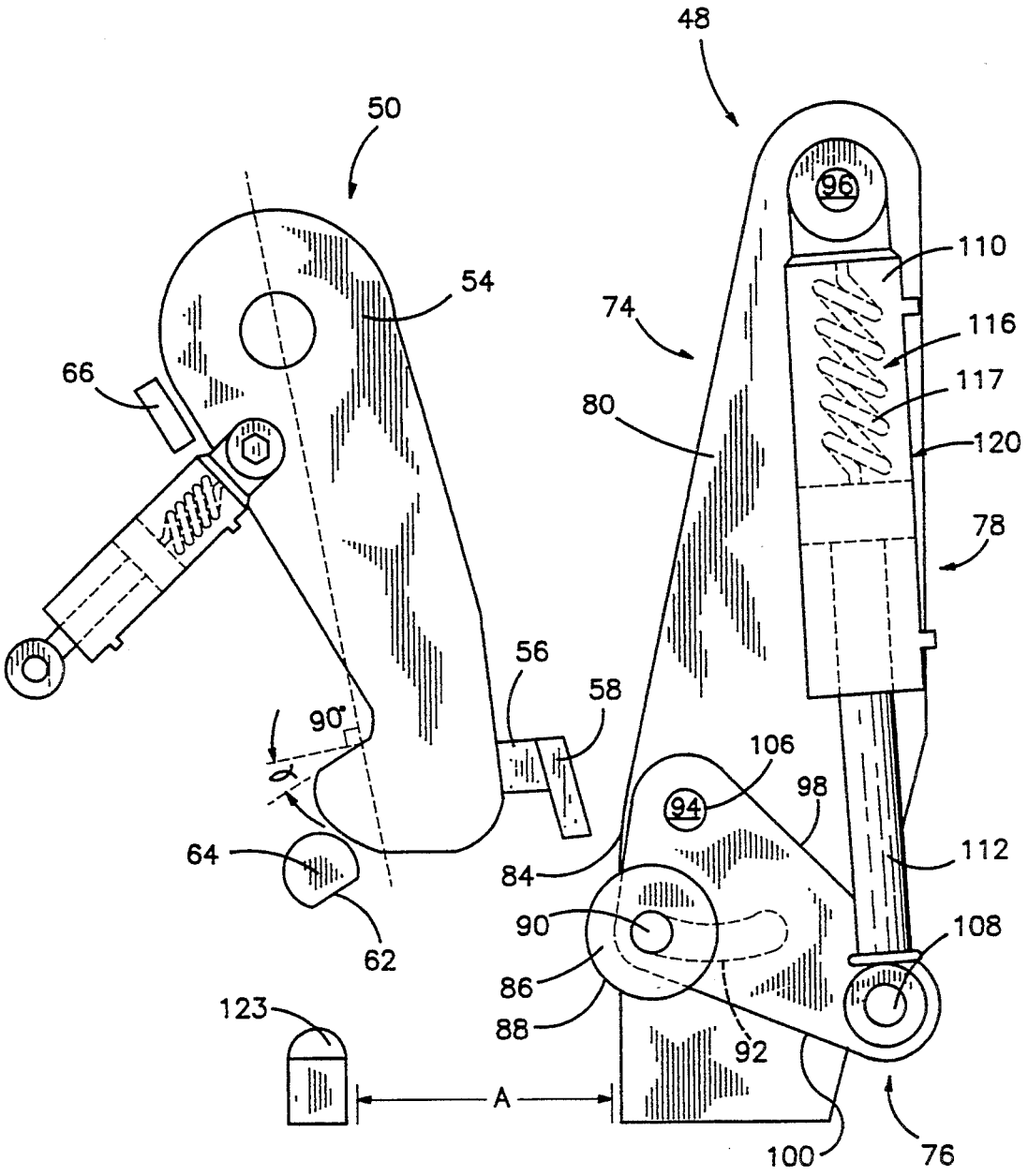
FIG. 6 is a schematic view of the engagement device of the present invention just prior to engagement of the hook member and the pin.

In this preferred embodiment, the lower sheave assembly 26 has the hook member 50 of the hook assembly 42 pivotally mounted on each of its side plates 52. Hook member 50, more clearly shown in FIG. 5, includes two hooks 54 rigidly connected by a rigid retaining bar 56. The rigid retaining bar 56 includes a slide plate 58 for contacting the engagement retaining assembly 48 when in use. Each of hooks 54 also has a hook surface 60 adapted for engagement with a pin surface 62 of the pin 64 of the pin assembly 46. As shown in FIG. 6, the hook surfaces 60 are smooth planar surfaces disposed at an angle, alpha, from a line perpendicular to the hook member's 50 axis of rotation. Alpha may be any angle which will generate a disengaging rotational force against the hook member 50 when the hook member 50 is not locked in engagement and will provide vertical force to the lower block assembly 14 when the hook member 50 is locked in engagement. In this preferred embodiment, alpha is about 30 degrees.

The pin surface 62 is also a smooth planar surface. The pin surface 62 is disposed at an angle which will allow a planar portion of the hook surfaces 60 to contact a planar portion of the pin surface 62. Hook stops 66 are provided on each of the side plates 52 to position the hooks 54, under the force from the biasing element 44, in a position such that the hooks 54 are deflected around pin 64 during engagement of the lower sheave assembly 26 and the lower block assembly 14. In this preferred embodiment biasing element 44 consists of shock absorbers 68 connected between the hooks 54 of hook member 50 and each of the side plates 52 of the lower sheave assembly 26. The shock absorbers 68 have sufficient pulling strength to keep the hook member 50 biased against the hook stops 66 but are sufficiently resilient to allow the hook member 50 to be deflected in use. Although shock absorbers 68 are used in this preferred embodiment, other biasing element such as springs are also suitable.

The pin assembly 46 of this preferred embodiment includes two brackets 70 rigidly connected to the lower block assembly 14. A pin 64, more clearly seen in FIGS. 6–9, is connected between the two brackets 70. The two brackets 70 are spaced apart a distance sufficient to allow the hooks 54 of hook member 50 to be received between the two brackets 70.

Also shown in FIG. 4 is a preferred engagement retaining assembly 48 in connection with the lower block assembly 14. Referring to FIG. 6, the engagement retaining assembly 48 comprises: a bracket member, generally indicated by the numeral 74; a pivoting member, generally indicated by the numeral 76, and a locking element, generally indicated by the numeral 78.

The bracket member 74 in this preferred embodiment is constructed of two metal bracket plates 80 attached perpendicular to the upper surface 82 of the lower block assembly 14. The bracket plates 80 are positioned such that edges 84 are a distance A away from pin 64. The distance A must be sufficient to allow the engaging portion of the hook member 50 to pass between the pin 64 and the edges 84, but not so great that the pivoting member 76 cannot operatively contact the hook member 50. The term "operatively contact" means physically contact the hook member either directly or indirectly such as through an intermediate part. This preferred embodiment includes such an intermediate part in the form of a roller member 86. The roller member 86 has an outer surface 88, adapted to contact the hook member 50, and an axle 90 in connection with its center of rotation. The axle 90 extends outwardly from the roller and is mounted within a guide 92 (described below) which guides the translational movement of the roller member 86 toward and away from the hook member 50 when in use.

Each of the bracket plates 80 is provided with two pivotal connecting points 94, 96 for connection with the pivoting member 76 and the locking assembly 78. Each bracket plate 80 also includes an elongated guide 92. The guide 92 is adapted to slidingly receive one end of the axle 90 of the roller member 86. When the bracket plates 80 are mounted to the lower block assembly 14 and each end of the axle 90 is received within a guide 92, the roller member is free to both rotate about its center of rotation and to move in a direction toward and away from the hook member The pivoting member 76 in this preferred embodiment is constructed of two metal pivot plates 98 having a continuous edge 100. The pivot plates 98 are rigidly connected by a connecting pin 106 and 108. Connecting pin 106 extends out past the pivoting member 76 and pivotally connects the pivoting member 76 and the bracket member 74 at a pivotal connecting point 94. Connecting pin 108 is adapted to allow connection of the locking assembly 78.

In a preferred embodiment the locking assembly 78 comprises a hydraulic cylinder 110; a hydraulic ram 112; a hydraulic fluid reservoir 114; a biasing element 116; and a valve 118, controllable by an operator. The hydraulic cylinder 110 and hydraulic ram 112 form the hydraulic assembly 120. One end of the hydraulic assembly 120 is pivotally attached to pin 108 of pivoting member 76 and the other end is pivotally attached to the bracket member 74 at a pivotal connecting point 96. The biasing element 116 is included to urge the hydraulic assembly 120 to either collapse or expand in length. Although it is possible to allow the weight of the hydraulic ram 112 to perform this task, in this preferred embodiment a spring 117 is installed within the hydraulic cylinder 110 to bias the hydraulic ram 112 outwardly. It is, however, contemplated by the invention that other means may be used to urge the hydraulic assembly 120 to collapse or expand, such as connecting a spring between the pivoting member 76 and the bracket member 74 or using hydraulic fluid under pressure.

In this configuration, movement of the hydraulic ram 112 within the hydraulic cylinder 110 causes the pivoting member 76 to pivot about its pivotal connection 94 with the bracket member 74. This pivoting action allows the pivoting member 76 to operatively contact the hook member 50 in operation.

Figure 7:
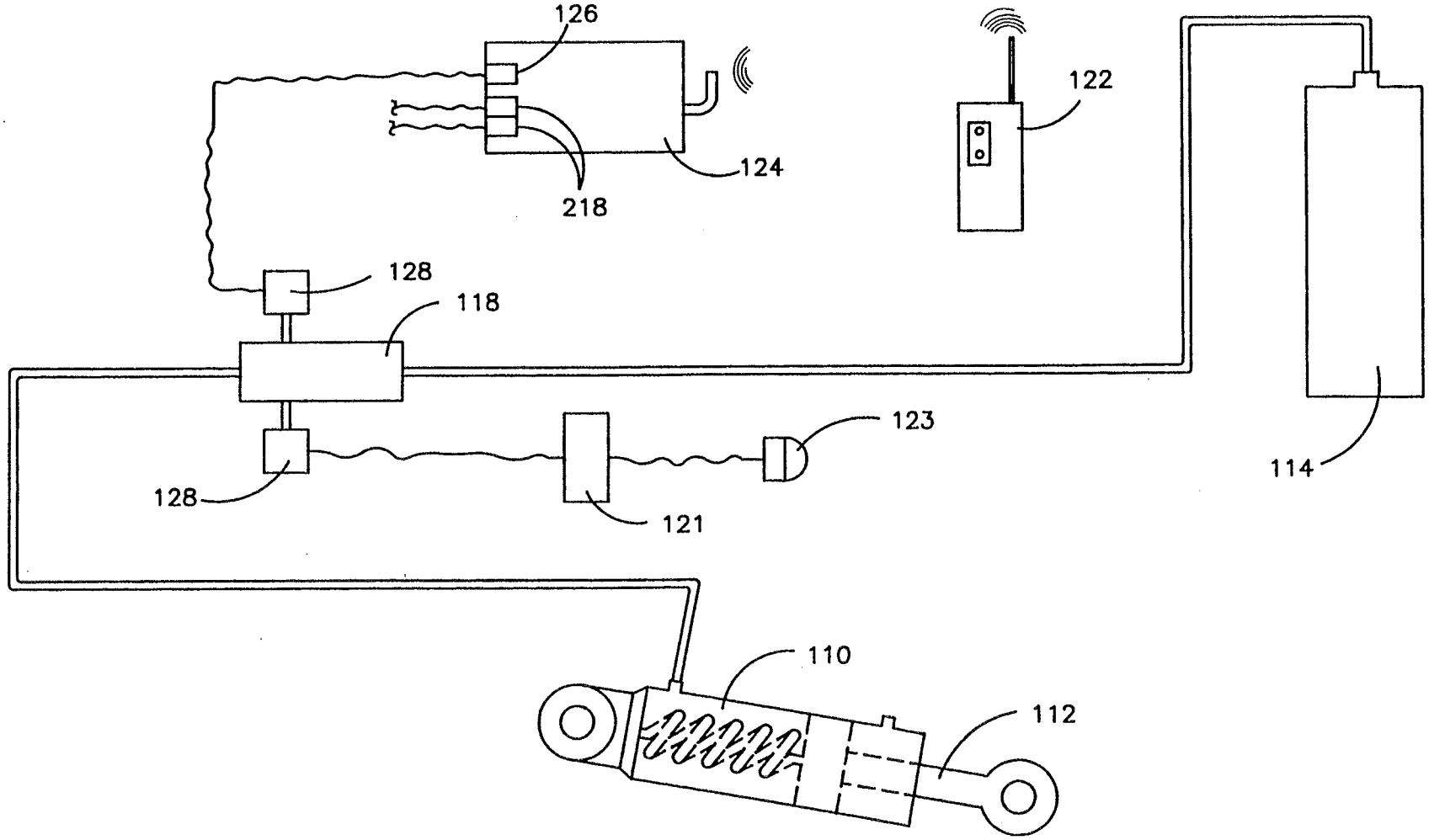
FIG. 7 is a schematic view of the hydraulic assembly and hydraulic system of the locking element of the engagement device of the present invention.

FIG. 7 is a schematic view of the locking assembly 78. Movement of the hydraulic ram 112 within the hydraulic cylinder 110 requires that hydraulic fluid move between the hydraulic cylinder 110 and the hydraulic fluid reservoir 114. The movement of hydraulic fluid between the hydraulic cylinder 110 and the hydraulic fluid reservoir 114 is controlled by the valve 118. The hydraulic assembly 120 is locked when the valve 118 is in the closed position and is unlocked when the valve 118 is in the opened position. In this preferred embodiment the valve 118 is a two position solenoid controlled valve.

Positioning of the valve 118 into the opened position is controlled by the operator via a radio link between a portable radio transmitter 122 and a portable radio receiver 124. The radio receiver 124 has an output port 126 controllable by the radio transmitter 122. The output port 126 is connected electrically to the solenoid 128 of the valve 118. Valve 118 is selectably opened by an operator using the radio transmitter 122.

Positioning of the valve 118 into the closed position is controlled automatically by any means which will detect that the hook member 50 is engaged with the pin assembly 46. In this preferred embodiment an electric circuit 121, which includes a proximity switch 123 mounted to the top of the lower block assembly 14 beneath the pin 64 of the pin assembly 46, is used to detect when the hook member 50 and the pin 64 are engaged. A proximity switch 123 suitable for use is available from Turk, Inc., Minneapolis, Minn. under the part no. BI15-CP40-VN4X. When engagement is detected, the valve 118 is automatically positioned, by electric circuit 121 into the closed position—locking the hydraulic assembly 120. Automatically locking of the hydraulic assembly 120 prevents damage to the engagement device caused by premature locking of the hydraulic assembly 120.

Figure 10:
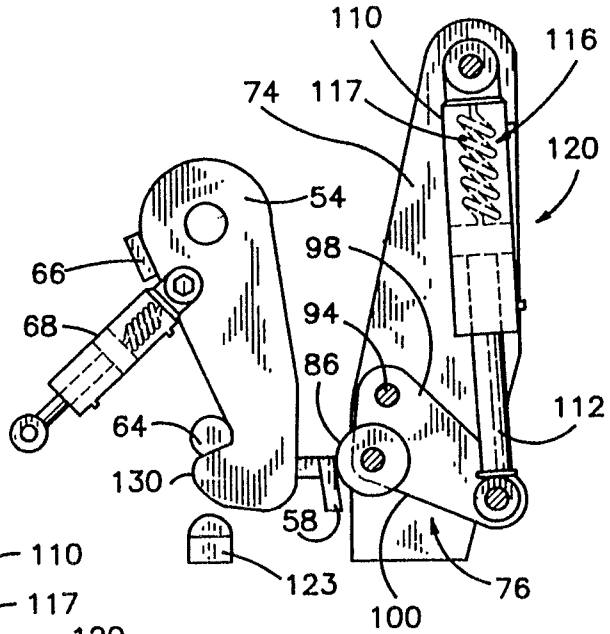
FIG. 10 is a schematic view of the engagement device of the present invention showing the engagement device in the locked position.
Figure 9:
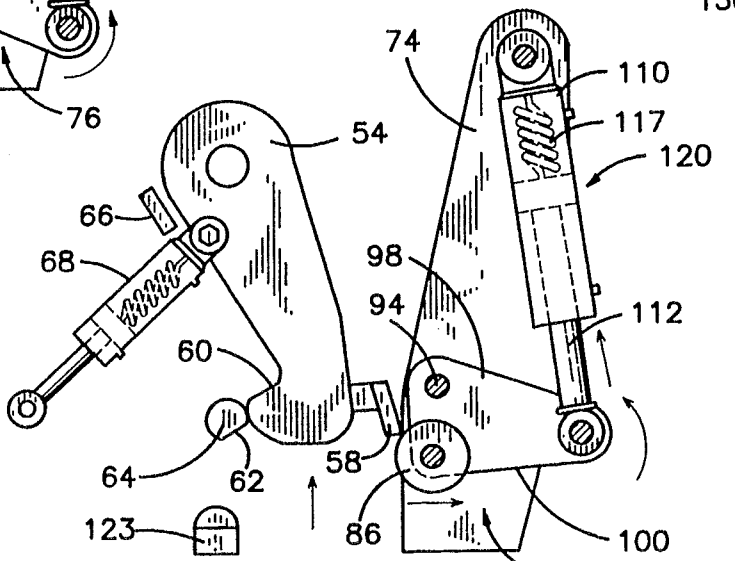
FIG. 9 is a schematic view of the engagement device of the present invention showing a preferred hook member deflecting the roller member during disengagement.
Figure 8:
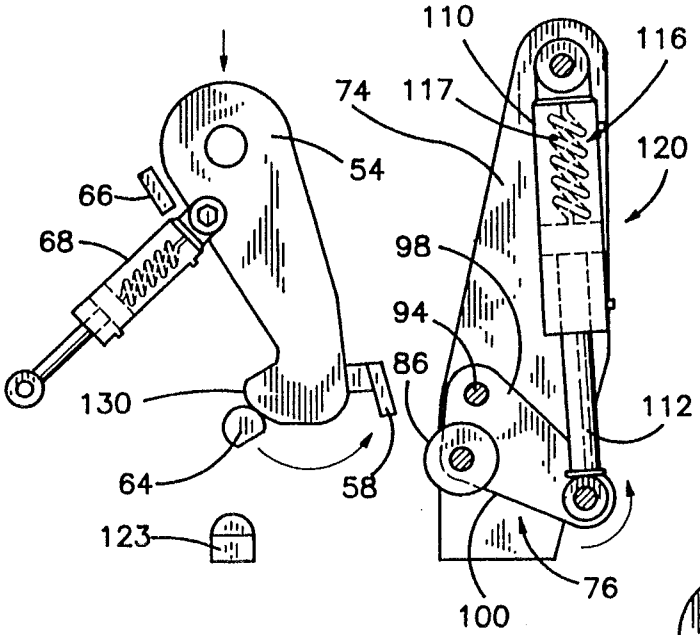
FIG. 8 is a schematic view of the engagement device of the present invention just before engagement of the hook member and the pin.

FIGS. 8–10 illustrate operation of the preferred embodiment of the engagement device. In FIG. 8 the lower sheave assembly 26 is advancing downwardly toward the lower block assembly 14 and valve 118 is in the opened position. As the hooks 54 contact the pin 64, the weight of the lower sheave assembly 26 generates a force causing the hooks 54 to be deflected by the pin 64 in a direction opposite of that urged by the shock absorbers 68. As the hooks 54 continue downward, the slide plate 58 contacts and deflects roller member 86 causing pivoting member 76 to pivot about its pivotal connection 94. This pivotal movement causes the hydraulic ram 12 to move within the hydraulic cylinder 10. This is possible because the valve 118 is in the opened position.

Once the tips 130 of hooks 54 have passed the pin 64, the shock absorbers 68 cause the hooks 54 to rotate into the position shown in FIG. 10. When the hooks 54 are in this position the slide plate 58 is no longer contacting the bracket member 74 allowing the spring 117 to cause the pivoting member 80 to pivot; urging the roller member 86 against the slide plate 58 and causing the hydraulic ram 112 to move downwardly in the hydraulic cylinder 110. Once this has happened, the proximity sensor 123 is triggered and the valve 118 is automatically positioned by the electric circuit 121 into the closed position. This locks the hydraulic assembly 120, thereby locking the roller member 86 against the slide plate 58. The lower sheave assembly 26 and the lower block assembly 14 are now engaged, allowing the bucket segments 12 to be closed and the bucket lifted by tightening the cable 36 as shown in FIG. 3.

When the bucket has been moved to the desired location for emptying, the operator positions the valve 18, via the radio link, into the opened position to disengage the lower block assembly 14 from the lower sheave assembly 26. The action of the engaging device during disengagement is illustrated in FIG. 9.

As illustrated, the force from the weight of the lower block assembly 14 causes a downward force on the pin 64. This downward force is translated to a rotational force against hooks 54 by the angle of the engagement surfaces 60. This rotational force is resisted by the locked hydraulic assembly 120. However, once the hydraulic assembly 120 is unlocked by opening the valve 118, the rotational force is no longer prevented from causing the hooks 54 to pivot away from the pin 64. Once hook tips 130 clear the pin 64, the lower block assembly 14 is disengaged from the lower sheave assembly 26. The bucket segments 12 are now forced open by the weight of gravity.

In order to reduce the impulse shock, associated with opening the buckets segments 12 while in midair, to the boom or crane, the preferred embodiment of the invention includes two damping devices to control the motion of the bucket segments 12 as they open. Although two damping devices are included in this preferred embodiment to achieve smoother operation and added safety, it is contemplated by the inventors that only one such device is necessary.

Figure 11:
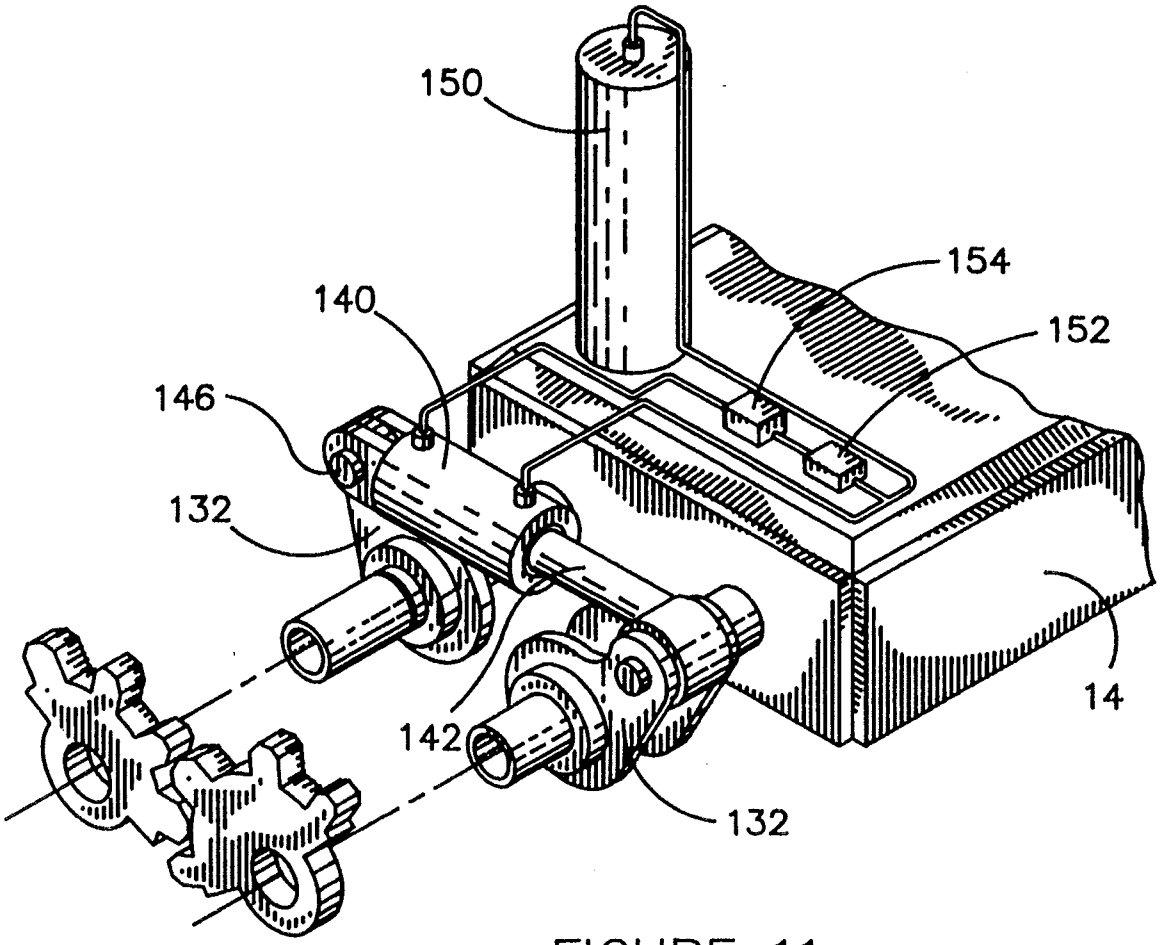
FIG. 11 is a schematic illustration of the damping device of the present invention when the bucket segments are in the closed position.
Figure 12:
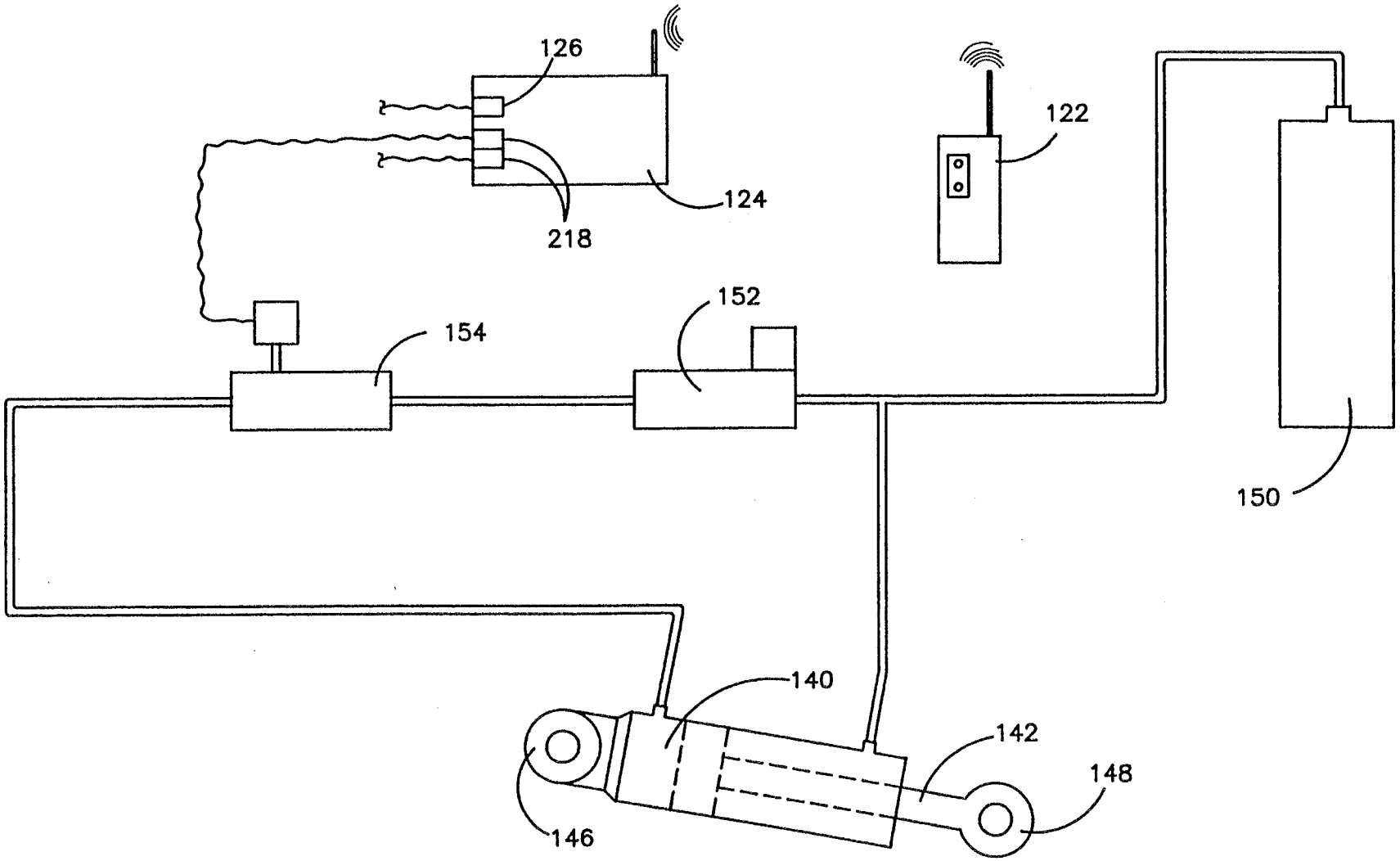
FIG. 12 is a schematic view of the radio receiver and solenoid operated valve of the damping device of the present invention.
Figure 13:
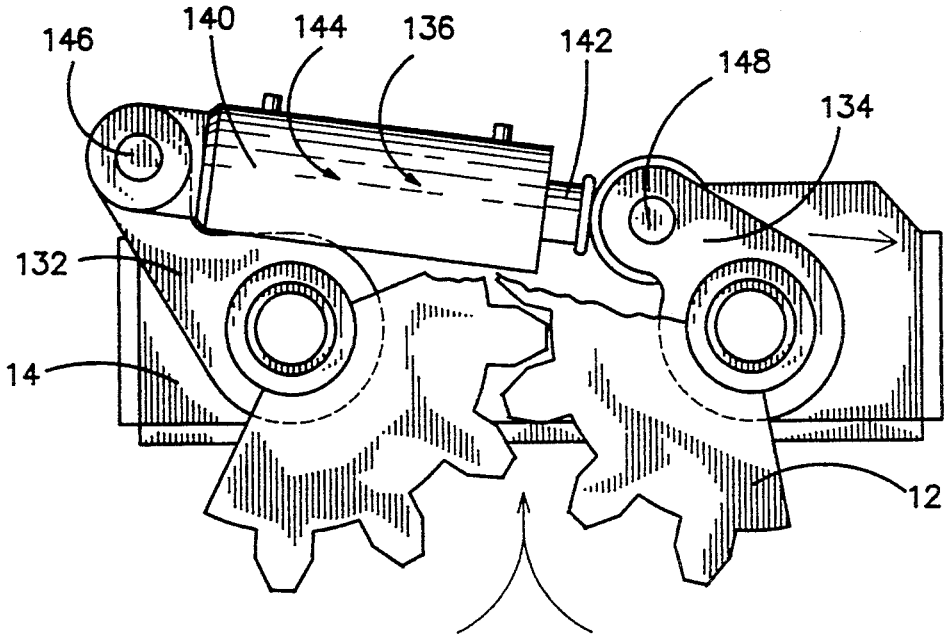
FIG. 13 is a schematic view of the damping device of the present invention showing rotation of the gears in relation to compression of the hydraulic assembly.
Figure 14:
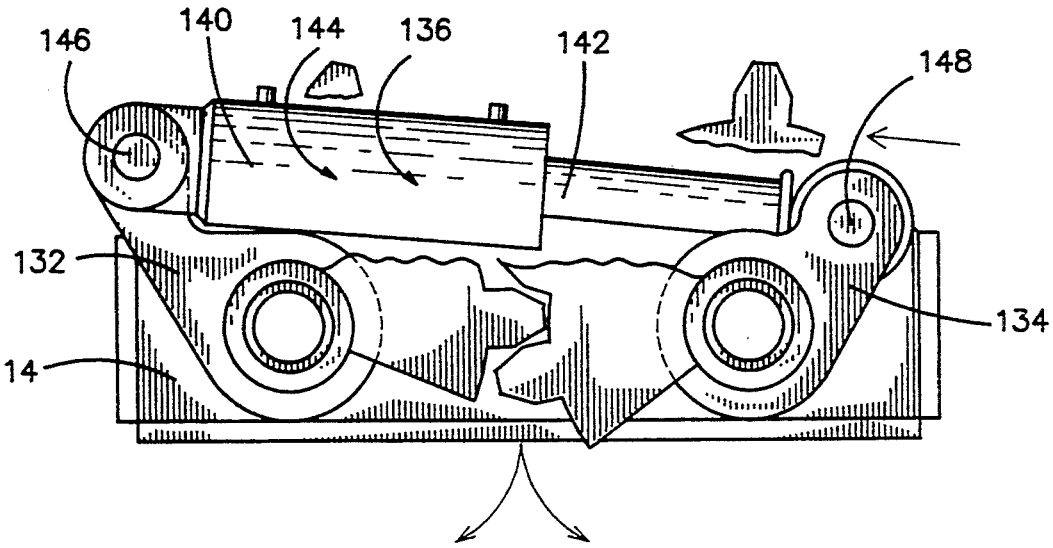
FIG. 14 is a schematic view of the damping device of the present invention showing rotation of the gears in relation to extension of the hydraulic assembly.

FIGS. 11–14 illustrate the components and operation of the damping device of the present invention. FIG. 11 is an isometric view of a preferred embodiment of the damping device of the present invention in connection between the lower block assembly 14 and the bucket segments 12. The damping device includes a first lever arm 132, a second lever arm 134 and a damping assembly 136. The first lever arm 132 is rigidly attached to the lower block assembly 14 at one end. The second lever arm 134 is rigidly mounted to the gear 13 of one of the bucket segments 12 and pivotally mounted to the lower block assembly 14. The damping assembly 136 includes a hydraulic cylinder 140 and a hydraulic ram 142 that are mounted together to form a hydraulic assembly 144. The hydraulic assembly 144 is pivotally mounted at one end 146 to the end of the first lever arm 132 that is not rigidly attached to the lower block assembly 14. The other end 148 of the hydraulic assembly 140 is pivotally mounted to the end of the second lever arm 134 not rigidly attached to a bucket segment As shown in FIG. 12, the damping assembly also includes a hydraulic fluid reservoir 150, in fluid connection with the hydraulic cylinder 140; and a hydraulic fluid flow control device 152. The hydraulic fluid flow control device 152 is controllable by an operator and is connected between the hydraulic cylinder 140 and the hydraulic fluid reservoir 150. The hydraulic fluid flow control device 152 restricts the rate of flow of hydraulic fluid from the hydraulic cylinder 140 to the hydraulic fluid reservoir 150 when the hydraulic ram 142 is urged in a predetermined direction within the hydraulic cylinder 140. FIGS. 13 and 14 illustrate movent of the gears 13 in connection with the hydraulic cylinder 140 and hydraulic ram 142.

In this preferred embodiment the hydraulic cylinder 140 and the hydraulic ram 142 have sufficient holding strength to stop and hold the bucket segments 12 in a partially open position when the bucket segments 12 are moving between a fully closed and fully open position. Also, in this preferred embodiment, the hydraulic fluid flow control device 152 also includes a solenoid controlled valve 154 in electrical connection with a second output port 218 of the portable radio receiver 124. The valve 154 may be moved into the closed position, by the operator, in order to stop and hold the bucket segments 12 in a desired configuration. This feature allows the bucket to slowly discharge its load from the partially opened bucket segments 12 in a more controlled fashion.

Numerous modifications and variations of the structure herein described are possible without departing from the present invention. Accordingly, it is should be clearly understood that the form of the invention herein described in the figures of the accompanying drawings are illustrative only and are not intended to limit the scope of the disclosed invention.

What I claim is:

1. A device, mountable in a single-line clamshell bucket, for engaging and disengaging a lower sheave assembly and a lower block assembly of a single-line clamshell bucket, said device comprising:

a hook assembly including a hook member pivotally mounted to said clamshell bucket;

a biasing element connected to said hook assembly in a manner such that said hook member is biased in a first rotational direction but is deflectable in a second rotational direction by a force generated by the weight of said lower sheave assembly;

a pin assembly having a pin including a first surface for engaging a second surface of said hook member in a manner such that, when said first and second surfaces are engaged, a force acting to separate said lower sheave assembly and said lower block assembly will act to generate a disengaging force against said hook member in said second rotational direction; and an engagement retaining assembly including a bracket member, a pivoting member pivotally mounted to said bracket member in a manner such that a portion of said pivoting member may operatively contact said hook member when said hook member and pin are engaged, and a hydraulic locking assembly, in mechanical connection with said pivoting member, for locking said pivoting member in a desired position, said hydraulic locking assembly being selectably unlockable by an operator and having sufficient holding strength to resist said disengaging force when locked.

2. The device of claim 1 wherein said engagement retaining assembly further includes a roller member having an axle member in connection with a center of rotation of said roller member and an outer surface selectively contacting said hook member, and an axle member guide, receiving said axle member and guiding it translational movement of said roller member along a predetermined pathway toward and away from said hook member.

3. The device of claim 2 wherein said bracket member includes said axle member guide and said pivoting member includes said roller member.

4. The device of claim 1 wherein said hydraulic locking assembly includes: a cylinder and a ram forming a hydraulic cylinder and ram assembly, pivotally mounted at one end to said pivoting member and pivotally mounted at an opposite end to said bracket member; a hydraulic fluid reservoir, in fluid connection with said cylinder; and a valve, controllable by an operator, connected between said cylinder and said hydraulic fluid reservoir.

5. The device of claim 4 wherein said hydraulic; locking assembly further includes a spring, installed within said cylinder, in mechanical connection with said ram in a manner such that said ram is biased in a predetermined direction.

6. The device of claim 4 wherein said hydraulic locking assembly further includes a radio transmitter, controllable by an operator; a radio receiver having an output port controllable by said radio transmitter; and wherein said valve is a solenoid controlled valve in electrical connection with said output port of said radio receiver.

7. The device of claim 6 wherein said solenoid controlled valve is a two position dual solenoid valve and said hydraulic locking assembly further includes an electric circuit including a detector device detecting when said hook assembly and said pin assembly are engaged, said output port of said radio receiver being in electrical connection with one solenoid of said dual solenoid valve and said electric circuit being in electrical connection with a second solenoid of said dual solenoid valve.

8. The device of claim 1 wherein said hook member includes two hooked members, pivotally mounted to said lower sheave assembly and rigidly connected together by a rigid retaining bar having a surface for engaging said pivoting member.

9. The device of claim 8 wherein said biasing element is a shock absorber connected at one end to said lower sheave assembly and an opposite end to said hook member.

10. The device of claim 1 wherein said pin assembly includes two brackets rigidly mounted to said lower block assembly, each of said brackets having an end of said pin rigidly mounted thereto, said pin being of a length and said brackets being spaced apart a distance sufficient to receive said hook member therebetween.

11. A device for damping the forces associated with opening a clamshell bucket while suspended in midair that is mountable in a single-line clamshell bucket having bucket segments pivotally mounted to a lower block assembly in a manner such that the pivotal movement of one of said bucket segments requires the pivotal movement of all other bucket segments, said device comprising:

a first lever arm, having a first and second end, rigidly attached at said first end to said lower block assembly;

a second lever arm, having a first and second end, rigidly attached at said first end to a bucket segment in a manner such that a force acting on said second end of said second lever arm will cause said bucket segments to pivot;

a damping assembly including: a cylinder and ram forming a hydraulic cylinder and ram assembly, pivotally mounted at one end to said second end of said first lever arm and pivotally mounted at an opposite end to said second end of said second lever arm; a hydraulic fluid reservoir, in fluid connection with said cylinder; and a hydraulic fluid flow control device, controllable by an operator and connected between said cylinder and said hydraulic fluid reservoir, for restricting the rate of flow of hydraulic fluid from said cylinder into said hydraulic fluid reservoir when said ram is urged in a predetermined direction within said cylinder.

12. The device of claim 11 wherein said hydraulic cylinder and ram assembly has sufficient holding strength to stop and hold said bucket segments in a partially open position when said bucket segments are moving between a fully closed and fully open position, and said hydraulic fluid flow control device further includes: a radio transmitter, controllable by an operator; a radio receiver having an output port controllable by said radio transmitter; and a solenoid controlled valve in electrical connection with said output port of said radio receiver.

13. A single-line clamshell bucket comprising;

an upper sheave housing;

an upper sheave assembly connected to said upper sheave housing;

a lower sheave assembly vertically aligned beneath said upper sheave assembly in a manner such that a cable reeved between said lower sheave assembly and said upper sheave assembly will draw said upper sheave assembly and said lower sheave assembly together when said cable is pulled upward;

a plurality of bucket segments;

a plurality of arms, each of said arms having an end pivotally connected to said upper sheave housing and another end pivotally connected to one of said bucket segments;

a lower block assembly pivotally linked with said bucket segments in a manner such that vertical movement of said lower block assembly in relation to said upper sheave housing opens and closes said bucket segments;

a guide, in operational connection between said upper sheave housing and said lower block assembly, which suppresses relative movement of said upper sheave housing and said lower block assembly in all directions other than directly toward and away from each other; and a connector assembly including (a) a hook assembly including a hook member pivotally mounted to said clamshell bucket;

(b) a biasing element connected to said hook assembly in a manner such that said hook member is biased in a first rotational direction but is deflectable in a second rotational direction by a force generated by the weight of said lower sheave assembly;

(c) a pin assembly having a pin including a first surface for engaging a second surface of said hook member in a manner such that, when said first and second surfaces are engaged, a force acting to separate said lower sheave assembly and said lower block assembly will act to generate a disengaging force against said hook member in said second rotational direction; and (d) an engagement retaining assembly including a bracket member, a pivoting member pivotally mounted to said bracket member in a manner such that a portion of said pivoting member may operatively contact said hook member when said hook member and pin are engaged, and a hydraulic locking assembly, in mechanical connection with said pivoting member, for locking said pivoting member in a desired position, said hydraulic locking assembly being selectably unlockable by an operator and having sufficient holding strength to resist said disengaging force when locked.

14. The single-line clamshell bucket of claim 13 wherein said engagement retaining assembly further includes a roller member having an axle member and an outer surface selectively contacting said hook assembly, and an axle member guide, receiving a portion of said axle member and guiding a translational movement of said roller member along a predetermined pathway toward and away from said hook member.

15. The single-line clamshell bucket of claim 14 wherein said bracket member includes said axle member guide and said pivoting member includes said roller member.

16. The single-line clamshell bucket of claim 13 wherein said hydraulic locking assembly further includes a radio transmitter, controllable by an operator; a radio receiver having an output port controllable by said radio transmitter; and having a solenoid controlled valve in electrical connection with said output port of said radio receiver.

17. The single-line clamshell bucket of claim 16 wherein said solenoid controlled valve is a two position dual solenoid valve and said hydraulic locking assembly further includes an electric circuit including a detector device detecting when said hook assembly and said pin assembly are engaged, said output port of said radio receiver being in electrical connection with one solenoid of said dual solenoid valve and said electric circuit being in electrical connection with a second solenoid of said dual solenoid valve.

18. The single-line clamshell bucket of claim 17 wherein said biasing element is a shock absorber connected at one end to said lower sheave assembly and at an opposite end to said hook member.

19. The single-line clamshell bucket of claim 13 wherein said hook member includes two hooked members, pivotally mounted to said lower sheave assembly and rigidly connected together by a rigid retaining bar having a surface for engaging said pivoting member.

20. The single-line clamshell bucket of claim 13 wherein said pin assembly includes two brackets rigidly mounted to said lower block assembly, each of said brackets having an end of said pin rigidly mounted thereto, said pin being of a length and said brackets being spaced apart a distance sufficient to receive said hook member therebetween.

21. The single-line clamshell bucket of claim 13 wherein said bucket segments are pivotally mounted to said lower block assembly in a manner such that the pivotal movement of one of said bucket segments requires the pivotal movement of all other bucket segments, and said bucket further includes a bucket damping assembly, mechanically connected between said lower block assembly and one of said bucket segments, for damping the forces associated with opening said bucket segments while said bucket is suspended in mid-air.

22. The single-line clamshell bucket of claim 21 wherein said bucket damping assembly comprises:

a first lever arm having a first and second end, rigidly attached at said first end to said lower block assembly;

a second lever arm, having a first and second end, rigidly attached at said first end to a bucket segment in a manner such that a force acting on said second end of said second lever arm will cause said bucket segments to pivot;

a damping element including: a cylinder and a ram forming a hydraulic cylinder and ram assembly, pivotally mounted at one end to said second end of said first lever arm and pivotally mounted at an opposite end to said second end of said second lever arm; a hydraulic fluid reservoir, in fluid connection with said cylinder; and a hydraulic fluid flow control device, connected between said cylinder and said hydraulic fluid reservoir, for restricting the rate of flow of hydraulic fluid from said cylinder into said hydraulic fluid reservoir when said ram is urged in a predetermined direction within said cylinder.

23. The single-line clamshell bucket of claim 22 wherein said hydraulic cylinder and ram assembly has sufficient holding strength to stop and hold said bucket segments in a partially open position when said bucket segments are moving between a fully closed and fully open position, and said hydraulic fluid flow control device further includes: a radio transmitter, controllable by an operator; a radio receiver having an output port controllable by said radio transmitter; and a solenoid controlled valve in electrical connection with said output port of said radio receiver.

24. A single line clamshell bucket comprising an upper sheave housing, a plurality of arms, each of said arms being connected at one end to said upper sheave housing and at an opposite end to one of a plurality of bucket segments, said bucket segments being pivotally connected to a lower block, an upper sheave assembly connected to said upper sheave housing, a lower sheave assembly connected by a cable to said upper sheave assembly, and a guide member connecting said lower sheave assembly and said lower block, wherein the improvement comprises:

(a) a connector assembly to selectively disengage said lower sheave assembly with said lower block, which comprises:

(i) a hook assembly including a hook member pivotally mounted to said clamshell bucket;

(ii) a pin assembly having a pin selectively engaging said hook member in a manner such that a force acting to separate said lower sheave assembly and said lower block assembly will act to generate a disengaging force against said hook member;

(iii) an engagement retaining assembly including a bracket member, a pivoting member pivotally mounted to said bracket member in a manner such that a portion of said pivoting member may operatively contact said hook member when said hook member and pin are engaged, and a hydraulic locking assembly, in mechanical connection with said pivoting member, for locking said pivoting member in a desired position, said hydraulic locking assembly being selectably unlockable by an operator and having sufficient holding strength to resist said disengaging force when locked; and (b) a bucket damping assembly which comprises:

(i) a fist lever arm, having a first and second end, rigidly attached at said first end to said lower block assembly;

(ii) a second lever arm, having a first and second end, rigidly attached at said fist end to a bucket segment in a manner such that a force acting on said second end of said second lever arm will cause said bucket segments to pivot;

(iii) a damping element including: a cylinder and a ram forming a hydraulic cylinder and ram assembly, pivotally mounted at one end to said second end of said first lever arm member not rigidly attached to said lower block assembly and pivotally mounted at an opposite end to said second end of said second lever arm; a hydraulic fluid reservoir, in fluid connection with said cylinder; and a hydraulic fluid flow control device, connected between said cylinder and said hydraulic fluid reservoir, for restricting the rate of flow of hydraulic fluid from said cylinder into said hydraulic fluid reservoir when said ram is urged in a predetermined direction within said cylinder.

25. The single-line clamshell bucket of claim 24 wherein said hydraulic locking assembly further includes a radio transmitter, controllable by an operator; a radio receiver having an output port controllable by said radio transmitter; and having a solenoid controlled valve in electrical connection with said output port of said radio receiver.

26. The single-line clamshell bucket of claim 25 wherein said solenoid controlled valve is a two position dual solenoid valve and said hydraulic locking assembly further includes an electric circuit including a detector device detecting when said hook assembly and said pin assembly are engaged, said output port of said radio receiver being in electrical connection with one solenoid of said dual solenoid valve and said electric circuit being in electrical connection with a second solenoid of said dual solenoid valve.

27. The single-line clamshell bucket of claim 24 wherein said hydraulic cylinder and ram assembly has sufficient holding strength to stop and hold said bucket segments in a partially open position when said bucket segments are moving between a fully closed and fully open position, and said hydraulic fluid flow control device further includes: a radio transmitter, controllable by an operator; a radio receiver having an output port controllable by said radio transmitter; and a solenoid controlled valve in electrical connection with said output port of said radio receiver.

* * * * *